US007871970B2

(12) United States Patent
Zanetto et al.

(10) Patent No.: US 7,871,970 B2
(45) Date of Patent: Jan. 18, 2011

(54) FORMULATIONS OF CARBOXYLIC ACID DIESTERS USEFUL FOR TREATING/CLEANING TEXTILE AND OTHER MATERIALS

(75) Inventors: Jean-Emile Zanetto, Paris (FR); Suresh Nair, Surrey (GB); Serkan Mutoy, Istanbul (TR)

(73) Assignee: Rhodia Operations, Aubervilliers (FR)

( * ) Notice: Subject to any disclaimer, the term of this patent is extended or adjusted under 35 U.S.C. 154(b) by 0 days.

(21) Appl. No.: 12/669,804

(22) PCT Filed: Jul. 16, 2008

(86) PCT No.: PCT/EP2008/059329

§ 371 (c)(1),
(2), (4) Date: May 25, 2010

(87) PCT Pub. No.: WO2009/013208

PCT Pub. Date: Jan. 29, 2009

(65) Prior Publication Data

US 2010/0240564 A1 Sep. 23, 2010

(30) Foreign Application Priority Data

Jul. 20, 2007 (FR) ..... 07 56631

(51) Int. Cl.
*C11D 3/44* (2006.01)
*C11D 1/72* (2006.01)

(52) U.S. Cl. ..... 510/211; 510/102; 510/201; 510/271; 510/276; 510/289; 510/356; 510/421; 510/432; 510/463

(58) Field of Classification Search ..... 510/102, 510/201, 211, 271, 276, 289, 356, 421, 432, 510/463
See application file for complete search history.

(56) References Cited

U.S. PATENT DOCUMENTS

| | | | | |
|---|---|---|---|---|
| 4,304,901 | A * | 12/1981 | O'Neill et al. | 524/602 |
| 5,674,823 | A * | 10/1997 | Ricca et al. | 510/102 |
| 5,817,885 | A | 10/1998 | Ricca et al. | |
| 2003/0186824 | A1 * | 10/2003 | Chiu et al. | 508/490 |
| 2004/0224870 | A1 * | 11/2004 | Doyel et al. | 510/412 |
| 2006/0287446 | A1 * | 12/2006 | Gao et al. | 526/124.3 |
| 2008/0200544 | A1 * | 8/2008 | Takeda et al. | 514/547 |

FOREIGN PATENT DOCUMENTS

| | | | |
|---|---|---|---|
| DE | 102005056230 | A1 | 5/2007 |
| EP | 0743358 | B1 | 11/1996 |
| FR | 2794476 | A1 | 12/2000 |
| WO | WO 96/01245 | A1 | 1/1996 |

* cited by examiner

*Primary Examiner*—Charles I Boyer
(74) *Attorney, Agent, or Firm*—Buchanan Ingersoll & Rooney PC

(57) ABSTRACT

Carboxylic acid diesters are employed for treating, in particular for cleaning textile and other materials, and more particularly for removing paint stains from textile fibers to improve the cleaning thereof; the subject formulations contain at least one dicarboxylic acid diester having the formula (I), $R^1$—OOC-A-COO—$R^2$, in which $R^1$ and $R^2$, which may be the same or different, are each a linear or branched, cyclic or non-cyclic $C_1$-$C_{20}$ alkyl, aryl, alkyaryl, or arylalkyl radical; and the group A is a branched divalent alkylene radical; and including at least one nonionic polyalkoxylated terpene surfactant.

21 Claims, No Drawings

FORMULATIONS OF CARBOXYLIC ACID DIESTERS USEFUL FOR TREATING/CLEANING TEXTILE AND OTHER MATERIALS

CROSS-REFERENCE TO PRIORITY/PCT APPLICATIONS

This application claims priority under 35 U.S.C. §119 of FR 0756631, filed Jul. 20, 2007, and is a continuation/national phase of PCT/EP 2008/059329, filed Jul. 16, 2008 and designating the United States (published in the French language on Jan. 29, 2009, as WO 2009/013208 A1; the title and abstract were also published in English), each hereby expressly incorporated by reference in its entirety and each assigned to the assignee hereof.

The invention relates to carboxylic acid diester formulations and to their use in the treatment of materials and more particularly the treatment of textiles in order in particular to remove paint stains.

In the various industrial painting workshops, such as, for example, in the automobile industry, the metal and plastic components are covered with various types of paint. Three layers are generally encountered:

an adhesion primer the base coat (paint+metal pigments)

the clear coat (transparent protective varnish).

The working overalls used by the employees who work in these painting workshops are very rapidly stained by these various coats and have to be changed at each change in shift. This results in major problems in cleaning.

Conventional detergents are inadequate in being able to act effectively against industrial paints and it is necessary to use solvents. As these are generally aggressive, either with regard to the user (corrosive, volatile) or with regard to the environment, or have properties which render them difficult to handle (excessively low flash point, high volatility), the demand for "green" solvents is high for this type of application.

Dicarboxylic acid diesters (also known as dibasic esters), the acid of which is linear, in particular the mixture of dimethyl succinate, glutarate and adipate, are known as "green" solvents.

U.S. Pat. No. 4,780,235 describes, for example, the combination of at least one di($C_1$-$C_4$ alkyl) ester of a dibasic aliphatic acid with 1 to 80% of N-methylpyrrolidone (NMP), a thickener and an "activating" molecule, such as acetic acid, for removing paint from surfaces of inflexible objects (stripping).

U.S. Pat. No. 5,613,984 describes a method for cleaning clothes stained by various types of paints comprising the stages consisting in exposing the stained item of clothing to a dibasic ester, in washing the item of clothing using a detergent comprising a surfactant and a solvent, and in then drying it. The dibasic ester is in particular a dibasic ester having an acid which is linear, such as the dimethyl succinate, glutarate and adipate mixture.

U.S. Pat. No. 4,673,524 describes a cleaning composition for removing, from the surface of the hands, materials which are difficult to remove, for example paints or printing inks. This composition comprises a dimethyl succinate, glutarate and adipate mixture in combination with an aliphatic hydrocarbon solvent and with a surfactant of ethoxylated nonylphenol type or in association with octophenoxy-polyethoxyethanol.

The document WO 96/30453 describes cleaning or stripping compositions for removing materials which are difficult to remove, for example paints from surfaces of inflexible objects. These compositions comprise a dimethyl succinate, glutarate and adipate mixture in combination with an ether, such as anisole, with optionally an aliphatic hydrocarbon solvent and with optionally a surfactant of ethoxylated nonylphenol type.

The document EP 743 358 describes compositions for cleaning textiles comprising a dimethyl succinate, glutarate and adipate mixture and a surfactant of ethoxylated fatty alcohol type.

However, the effectiveness of these solvents and compositions is further increased by being improved and there exists more particularly a need for solvents and compositions which are more effective in cleaning paint stains on textile fibers. There also exists a need for products not comprising ethoxylated nonylphenols, which are regarded, rightly or wrongly, as harmful to the environment and/or health.

The present invention meets this need by providing a liquid formulation, intended to be used in particular in the treatment of materials, characterized in that it comprises:

at least one dicarboxylic acid diester corresponding to the formula (I):

$$R^1\text{—OOC-A-COO—}R^2 \qquad \text{(I)}$$

wherein the $R^1$ and $R^2$ groups, which are identical or different, represent a linear or branched, cyclic or noncyclic, $C_1$-$C_{20}$ alkyl, aryl, alkylaryl or arylalkyl group, the A group represents a linear or branched divalent alkylene group, and at least one polyalkoxylated terpene nonionic surfactant.

Such a formulation makes it possible to clean in particular paint-stained textiles with a greater effectiveness than that obtained with the green solvents known to date. Furthermore, the dibasic esters used in the present invention are among the families of solvents which release low amounts of volatile organic compounds and which do not exhibit a major risk at the HSE (Health, Security and Environment) level.

Advantageously, said polyalkoxylated terpene nonionic surfactant is a polyethoxylated and/or polypropoxylated terpene, preferably a polyethoxylated and poly-propoxylated terpene, the ethoxy and propoxy units being distributed randomly or sequentially.

Preferably, said nonionic surfactant is a polyalkoxylated terpene corresponding to the following formula (III):

$$Z\text{—}X\text{—}[CH(R^5)\text{—}CH(R^6)\text{—}O]_n\text{—}[CH_2CH_2O]_p\text{—}[CH(R^5)\text{—}CH(R^6)\text{—}O]_q\text{—}R^7 \qquad \text{(III)}$$

in which formula:

Z represents a bicyclo[a.b.c]heptenyl or bi-cyclo[a.b.c.]heptyl radical, with $$a+b+c=5$$

a=2, 3 or 4, b=2 or 1 c=0 or 1, said radical optionally being substituted by at least one $C_1$-$C_6$ alkyl radical and comprising a Z backbone chosen from those indicated below or with the corresponding backbones devoid of a double bond:

[3.2.0]

a)

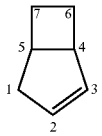

[3.2.0]

b)

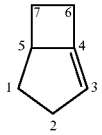

[2.2.1]

c)

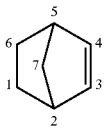

[3.1.1]

d)

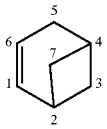

[3.1.1]

e)

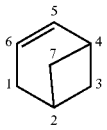

[4.1.0]

f)

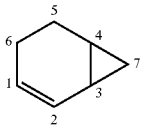

[4.1.0]

g)

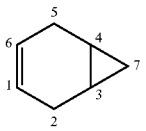

X represents —$CH_2$—$C(R^3)(R^4)$—O— or —O—$CH(R'^3)$—$C(R'^4)$—O—, in which:

$R^3$, $R^4$, $R'^3$ and $R'^4$, which are identical or different, represent hydrogen or a saturated or unsaturated and linear, branched or cyclic $C_1$-$C_{22}$, preferably $C_1$-$C_6$, hydrocarbon radical;

$R^5$ and $R^6$, which are identical or different, represent hydrogen or a saturated or unsaturated and linear, branched or cyclic $C_1$-$C_{22}$ hydrocarbon radical, with the condition that at least one of the $R^5$ and $R^6$ radicals is other than hydrogen;

$R^7$ represents hydrogen or a saturated or unsaturated, linear, branched or cyclic, aromatic or nonaromatic, $C_1$-$C_{22}$ hydrocarbon radical which is optionally substituted (for example by an OH group);

n, p and q are integers or nonintegers greater than or equal to 0, n+p+q>1, preferably from 2 to 200, preferably from 5 to 50.

Preferably, n, p and q are chosen so that:

n is an integer or noninteger between 2 and 10 inclusive;

p is an integer or noninteger between 3 and 20 inclusive;

q is an integer or noninteger between 0 and 30 inclusive.

Such a polyalkoxylated terpene nonionic surfactant is, for example, sold by Rhodia under the name Rhodaclean® MSC.

The $R^1$ and $R^2$ groups, which are identical or different, can in particular be chosen from the methyl, ethyl, n-propyl, isopropyl, benzyl, phenyl, n-butyl, isobutyl, cyclohexyl, hexyl, n-hexyl, isooctyl and 2-ethylhexyl groups. They correspond to the identical or different alcohols of formulae $R^2$—OH and $R^2$—OH.

According to an alternative form of the invention, the dicarboxylic acid diester is provided in the form of a mixture of different dicarboxylic acid diesters of formula (I).

In the present patent application, this diester of a dicarboxylic acid of formula (I) can be denoted by "specific diester" or "diester used in the invention".

It is possible to use one or more specific diesters. In the patent application, unless the presence of at least two specific diesters is explicitly mentioned, "a" specific diester can denote a single diester corresponding to the formula (I) or a mixture or a combination of several specific diesters corresponding to the formula (I).

The A group is a divalent alkylene group. The corresponding acid is the compound of formula HOOC-A-COOH. By misuse of language, the A group can be denoted by the acid to which it corresponds.

According to an alternative form of the invention, A is a linear divalent alkylene group of formula $(CH_2)_r$, where r is a mean number between 2 and 4 inclusive.

Preferably, A is chosen so that the diester can be a mixture of adipate diesters (r=4), glutarate diesters (r=3) and succinate diesters (r=2).

Advantageously, the diester used in the present invention is chosen from:

dimethyl adipate, a mixture of dimethyl adipate (for example, from 9 to 17% by weight, by Gas Chromatography), dimethyl glutarate (for example, from 59 to 67% by weight) and dimethyl succinate (for example, from 20 to 28% by weight), for example sold by Rhodia under the name Rhodiasolv® RPDE, diisobutyl adipate, a mixture of diisobutyl adipate (for example, from 9 to 17% by weight, by Gas Chromatography), diisobutyl-glutarate (for example, from 59 to 67% by weight) and diisobutyl succinate (for example, from 20 to 28% by weight), for example sold by Rhodia under the name Rhodiasolv® DIB.

According to another alternative form of the present invention, use is made of a diester of a dicarboxylic acid of formula (I), the A group of which is a branched divalent $C_3$-$C_{10}$ alkylene group. In the present patent application, this diester of a dicarboxylic acid can be denoted by "branched diester".

In the branched diester used in the invention, the A group can in particular be a $C_3$, $C_4$, $C_5$, $C_6$, $C_7$, $C_8$ or $C_9$ group or a mixture. It is preferably a $C_4$ group.

The A group is preferably chosen from the following groups:

the $A_{MG}$ group of formula —CH($CH_3$)—$CH_2$—$CH_2$— (corresponding to 2-methylglutaric acid), the $A_{ES}$ group of formula —CH($C_2H_5$)—$CH_2$— (corresponding to 2-ethylsuccinic acid), and their mixtures.

Advantageously, the branched diester is the dimethyl ester of 2-methylglutaric acid, corresponding to the following formula:

$$CH_3—OOC—CH(CH_3)—CH_2—CH_2—COO—CH_3.$$

According to a preferred embodiment, the specific diester is provided in the form of a mixture comprising the dicarboxylic acid diesters of the following formulae (I'), (I") and optionally (II):

$$R^2—OOC\text{-}A_{MG}\text{-}COO—R^2 \quad (I'),$$

$$R^1—OOC\text{-}A_{ES}\text{-}COO—R^2 \quad (I"),$$

$$\text{optionally } R^1—OOC—(CH_2)_4—COO—R^2 \quad \text{(II) (adipic acid diester)},$$

wherein:

$A_{MG}$ is a group of formula —CH($CH_3$)—$CH_2$—$CH_2$—, $A_{ES}$ is a group of formula —CH($C_2H_5$)—$CH_2$—.

In these formulae (I'), (I") and (II), the $R^1$ and $R^2$ groups can in particular be methyl, ethyl or isobutyl groups.

According to a particularly preferred embodiment of the present invention, the mixture of diesters comprises:

from 70 to 95% by weight of the dicarboxylic acid diester of formula (I'), preferably of the dimethyl ester, from 5 to 30% by weight of the dicarboxylic acid diester of formula (I"), preferably of the dimethyl ester, and from 0 to 10% by weight of the dicarboxylic acid diester of formula (II), preferably the dimethyl ester.

The diester used in the invention can be obtained by any known process leading to diesters, in particular by reaction of an alcohol corresponding to the $R^1$ and $R^2$ groups with a dicarboxylic acid corresponding to the A group or a di(acyl chloride) of formula ClOC-A-COCl or a corresponding dinitrile of formula NC-A-CN. In the case where use is made of several dicarboxylic acid diesters, for example the diesters of formulae (I'), (I") and optionally (II), it is possible to carry out the same type of reaction starting from a corresponding mixture of dicarboxylic acids or acyl chlorides or dinitriles.

The mixed branched diester or diesters can in particular be obtained from a mixture of dinitrile compounds in particular produced and recovered in the process for the manufacture of adiponitrile by double hydrocyanation of butadiene. This process, used on a large scale industrially to produce the great majority of the adiponitrile consumed worldwide, is described in numerous patents and works. The reaction for the hydrocyanation of butadiene results predominantly in the formation of linear dinitriles but also in the formation of branched dinitriles, the two main ones of which are methylglutaronitrile and ethylsuccinonitrile. In the stages for separation and purification of the adiponitrile, the branched dinitrile compounds are separated by distillation and recovered, for example, as top fraction in a distillation column.

Typically, the mixture of branched dinitrile compounds is converted to diesters in order thus to obtain a novel solvent.

One of the possible processes for the conversion of the dinitrile compounds to diesters corresponds to the use of the Pinner reaction, described in particular in French patent No. 1 488 857. Basically, this process consists in reacting the dinitrile compounds with an alcohol in the presence of a strong inorganic acid, such as sulfuric acid, and in then hydrolyzing the products obtained in order to recover the diesters by distillation. This document also describes a specific embodiment of the process which consists in passing the mixture of dinitrile compounds and the alcohol into a bath of molten salts based on different alkali metal sulfates and ammonium sulfate in order to prevent the formation of ammonium sulfate and to recover the ammonia by extraction with steam.

The diesters used in the invention can also be obtained by a reaction between the dinitrile compounds, water and an alcohol in the gas phase and in the presence of a solid catalyst. The reaction temperature is advantageously greater than the condensation temperature of the diesters formed. Use may be made, as catalyst, of a solid acid catalyst, such as, for example, a silica gel, a silica/alumina mixture or boric or phosphoric acids which are supported. Use may also be made of macroporous aluminas, such as those described in European patent EP 0 805 801. The reaction temperature is between 200 and 450° C., preferably between 230 and 350° C. The reaction can be carried out under any pressure, advantageously a pressure of between 0.1 and 20 bar. At the reactor outlet, the vapors are rapidly cooled to a temperature of less than or equal to 150° C. The ammonia and then the water and the excess alcohol are separated by distillation from the mixture obtained.

The diesters of the invention can also be obtained by reaction between the dinitrile compounds and an inorganic base, in order to obtain salts of acids, and then neutralization of these salts by an acid, followed by an esterification with an alcohol.

Finally, the diesters can be purified according to the purification processes conventionally used in the technical field of the preparation of organic compounds and in particular by distillation in one or more columns.

The mixture can comprise other compounds than the diester of the invention. It can in particular comprise byproducts of an esterification reaction and/or products resulting from byproducts of a prior reaction.

According to the invention, the specific diester is combined, in the liquid formulation, with at least one polyalkoxylated terpene nonionic surfactant preferably corresponding to the formula (III) defined above.

The use of surfactants of this specific type, which act synergistically with the specific diester, makes it possible to further increase the effectiveness of the specific diester, in particular for treating textiles.

Compounds of a first type are defined by the formula (III) in which X is equal to $$—CH_2—C(R^3)(R^4)—O—.$$

Thus, this compound, hereinafter compound (IIIa), corresponds to the following formula:

$$Z—CH_2—C(R^3)(R^4)—O—[CH(R^5)—CH(R^6)—O]_n—[CH_2CH_2—O]_p—[CH(R^5)—CH(R^6)—O]_q—R^7$$

in which formula Z, $R^3$, $R^4$, $R^5$, $R^6$, $R^7$, n, p and q have the general meanings indicated above.

Preferably, the Z radical is chosen from the radicals of formulae c) to g).

It should be noted that the Z radical is more particularly attached to the remainder of the chain via any one of the carbon atoms 1 to 6, the carbon atoms 1, 5 and 6 being preferred.

Furthermore, the Z radical can be substituted on at least one of its carbon atoms by two $C_1$-$C_6$ alkyl radicals, preferably two methyl radicals.

More particularly, the carbon 7 is substituted by these two alkyl radicals, more specifically two methyl radicals.

One of the preferred compounds used in the present invention is thus composed of a compound, the Z radical of which corresponds to one of those appearing in the figure c) to g) and more preferably a d) and e) radical; the Z radical being substituted by two methyl radicals located on the carbon 7.

Particularly preferably, the Z radical corresponds to the formula d) or e), attached to the remainder of the chain via the carbon 5 or 1 and carrying two methyl substituents on the carbon 7.

Preferably, $R^3$ and $R^4$, which are identical or different, represent a hydrogen or a methyl radical. Preferably, $R^3$ and $R^4$ represent a hydrogen atom.

As was indicated above, the $R^5$ and $R^6$ radicals, which are identical or different, represent hydrogen or a saturated or unsaturated and linear, branched or cyclic $C_1$-$C_{22}$ hydrocarbon radical, with the condition that at least one of the $R^5$ and $R^6$ radicals is other than hydrogen.

More particularly, said radicals represent hydrogen or a $C_1$-$C_6$ alkyl radical, preferably the methyl radical or the ethyl radical, with the condition that at least one of these two radicals is other than hydrogen. Preferably, one of the radicals represents hydrogen and the other represents a methyl radical.

$R^7$ represents hydrogen or a saturated or unsaturated, linear, branched or cyclic, aromatic or nonaromatic, $C_1$-$C_{22}$ hydrocarbon radical which is optionally substituted, for example by an OH group.

In the case where $R^7$ is a hydrocarbon radical, the latter is more particularly a $C_1$-$C_6$ alkyl radical or an alkylphenyl radical which is optionally substituted by a halogen (such as chlorine, for example).

Preferably, $R^7$ is a hydrogen atom.

According to a specific embodiment of the present invention, the value of n is 3.

In addition, the value of p is more particularly between 6.2 and 7, limits included. Preferably, p is between 6.3 and 7, limits included.

According to another specific embodiment of the invention, n is between 4 and 5, limits included.

Furthermore, the value of p is preferably between 7 inclusive and 10 exclusive, preferably between 8 inclusive and 10 exclusive.

Preferably, q is equal to 0. If q is other than 0, then q is preferably between 5 and 25, limits included.

Compounds of a second type are defined by the formula (III) in which X represents:

$$—O—CH(R'^3)—CH(R'^4)—O—.$$

Thus, this compound, hereinafter compound (IIIb), corresponds to the following formula:

$$Z—O—CH(R'^3)—C(R'^4)—O—[CH(R^5)—CH(R^6)—O]_n—[CH_2CH_2—O]_p—[CH(R^5)—CH(R^6)—O]_q—R^7$$

in which formula Z, $R'^3$, $R'^4$, $R^5$, $R^6$, $R^7$, n, p and q have the general meanings indicated above.

According to a preferred embodiment of the invention, the Z radical corresponds to the radical c), the bicyclic compound not comprising a double bond.

Here again, it should be noted that the Z radical is more particularly attached to the remainder of the chain via any one of the carbons 1 to 6. The carbon atoms 1, 3, 4 or 6 are more particularly selected.

Furthermore, the Z radical can be substituted on at least one of its carbon atoms by two $C_1$-$C_6$ alkyl radicals, preferably two methyl radicals.

More particularly, the carbon 7 is substituted by these two alkyl radicals, more specifically two methyl radicals.

Furthermore, the Z radical carries, on one of the carbon atoms 2 or 5, a $C_1$-$C_6$ alkyl substituent, preferably a methyl radical.

More particularly and as mentioned above, the $R'^3$ and $R'^4$ radicals, which are identical or different, represent hydrogen or a saturated or unsaturated and linear, branched or cyclic $C_1$-$C_{22}$ hydrocarbon radical, with the condition that one of the two is other than hydrogen.

According to a specific embodiment of the invention, said radicals represent hydrogen or a $C_1$-$C_6$ alkyl radical, preferably the methyl radical.

That which was indicated with regard to the $R^5$, $R^6$ and $R^7$ radicals and with regard to the values of n, p and q and the preferred alternative forms related to these values remains valid and will not be taken up again.

The compounds of formula (III) can be prepared by reacting:

in order to obtain compound (IIIa), a reactant of formula (IVa):

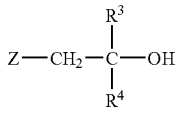

or, in order to obtain compound (IIIb), a reactant of formula (IVb):

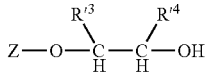

with, in a first step, a reactant of formula (Vop):

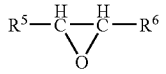

and then, in a second step, with a reactant of formula (Voe):

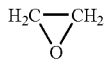

The Z, $R^3$, $R^4$, $R^5$ and $R^6$ radicals have been defined above.

The reaction can in addition be carried out in the presence of a catalyst.

Mention may be made, among suitable catalysts, of strong bases, such as hydroxides of alkali metals, alkaline earth metals or quaternary ammoniums of $N(R)_4^+$ type, in which the R groups, which are identical or different, represent hydrogen or a $C_1$-$C_6$ alkyl radical, preferably methyl or ethyl. Sodium hydroxide, potassium hydroxide and tetramethylammonium hydroxide are suitable for the implementation of this reaction.

Use may likewise be made of catalysts chosen from alkali metal or alkaline earth metal alkoxides, such as, for example, sodium methoxide, sodium ethoxide, sodium tert-butoxide, potassium methoxide, potassium ethoxide or potassium tert-butoxide. It should be noted that it is also possible to employ, as catalyst, primary, secondary or tertiary amines, preferably aliphatic amines, it being possible for these amines to comprise other functional groups, such as, in particular, ether functional groups. Mention may be made, as example of catalysts of this type, of N,N-dimethyllaurylamine.

In the case of a basic catalyst, the amount is more particularly between 0.5 and 40 mg with respect to the weight of the final product.

It is possible to envisage carrying out this reaction in the presence of a Lewis acid, such as $BF_3$ (gaseous or in solution in an ether), $SnCl_4$ or $SbCl_5$.

The amount of acid catalyst varies more particularly between 0.1 and 10 mmol per mole of reactant (IVa) or (IVb).

The contacting operation is carried out at a temperature sufficient to make it possible to accomplish the reaction. By way of indication, the temperature is greater than 100° C., more particularly between 120 and 250° C. and preferably between 150 and 200° C.

Advantageously, the reaction is carried out under an atmosphere which is inert under the reaction conditions, such as nitrogen, or a rare gas, such as argon, or also carbon monoxide. Nitrogen is preferred.

The reaction can take place at atmospheric pressure, under reduced pressure or with a slight excess pressure. Usually, it is preferable to operate under a pressure of between 1 and 4 bar.

The preparation of the reactants (IVa) and (IVb) has been described in application WO 96/01245, to which reference may be made.

The amounts of the compounds (Vop) and (Voe) are calculated according to the characteristics of the formula (III), more particularly according to the values desired for n and p.

These two compounds are introduced successively, so as to obtain a block compound of formula (III).

On conclusion of the reaction, the reaction mixture is preferably neutralized, in order to obtain a pH of between 5 and 8, preferably 6 and 7.

Neutralization is carried out using acetic acid or sodium hydroxide, sodium carbonate or sodium bicarbonate, according to the nature of the catalyst involved in the reaction.

On conclusion of this reaction, the compound (III) is such that the $R^7$ radical is hydrogen.

It is entirely possible to carry out a stage of functionalization of said radical, that is to say a stage targeted at converting the terminal hydrogen into one of the other $R^7$ radicals as defined above. Thus, it is possible to carry out an etherification or esterification operation on the terminal hydrogen atom; this stage is well known per se; it is preferably carried out after the neutralization.

Thus, the preparation of alkyl ethers ($R^7$=hydrocarbon radical) can be carried out according to the procedure described in U.S. Pat. No. 2,913,416.

Further details relating to these methods of functionalization are described in the publication WO 96/01245.

Advantageously, the surfactant corresponding to the formula (III) can be used diluted by adding up to 50% of water or organic solvent, such as polyethylene glycol.

The amount of polyalkoxylated terpene nonionic surfactant, preferably the surfactant corresponding to the formula (III), is advantageously between 0.1 and 10% by weight, preferably between 0.1 and 5% by weight, preferentially between 0.5 and 4% by weight and more preferentially still between 0.5 and 3% by weight, preferably between 0.5 and 2% by weight or even between 0.5 and 1% by weight, for example by weight as is or by weight of active material, with respect to the total amount of the formulation, preferably with respect to the total amount of compounds of the dicarboxylic acid diester type present in said liquid formulation. The formulation of the invention proves to be surprisingly effective, even at low contents of surfactant.

According to a specific embodiment, the formulation is substantially devoid of other nonionic surfactants, preferably of other surfactants in general.

As well as the solvent and the surfactant described above, the formulation according to the invention can also comprise:

a. water,
b. an additional cosolvent,
c. an additional surfactant, for example an anionic, nonionic (nonterpenic), amphoteric, zwitterionic and/or cationic surfactant,
d. an antioxidant,
e. a corrosion inhibitor,
f. a thickening agent,
g. a colorant,
h. a fragrance,
i. a stabilizer, or
j. any combination of the abovementioned components.

According to an embodiment, the formulation according to the invention does not comprise a hydrocarbon solvent.

According to one embodiment, the formulation according to the invention does not comprise a nonpolyalkoxylated terpene, such as limonene or oil of pine.

The additional surfactants can be chosen from standard surfactants. Known surfactants are given in the work McCutcheon's Emulsifiers & Detergents, North American & International Edition, 2004 Annuals.

According to a specific embodiment, the formulation according to the invention does not comprise poly-alkoxylated fatty alcohols, such as polyethoxylated and/or polypropoxylated fatty alcohols. According to a specific embodiment, the formulation according to the invention does not comprise polyalkoxylated alkyl-phenols, such as polyethoxylated and/or polypropoxy-lated nonyl- or octylphenols, if appropriate terminated by an ethyl or methyl unit.

The present invention also relates to the use, in the treatment of materials, of a liquid formulation, in particular a formulation as described above, comprising at least one dicarboxylic acid diester corresponding to the formula (I) as defined above and at least one poly-alkoxylated terpene nonionic surfactant.

According to one embodiment, said polyalkoxylated terpene nonionic surfactant corresponds to the formula (III) as defined above.

Advantageously, said material to be treated is chosen from the group comprising textiles, for example textiles made of polyester fibers, metals and plastics.

More particularly, said treatment of materials can comprise cleaning, in order to remove a stain, a coating or an agent for helping in the manufacture, such as a lubricant or an agent for combating adhesion (sludging agent, lubricants), on said material and more particularly on a textile. The use of the formulation according to the invention is particularly advantageous when said stain is a stain of aqueous- or solvent-based single-component or two-component paint, of resin, of vegetable- or mineral-based lubricant, of products derived from bitumens and petroleum, of mud, of greasy substances, of food residues, and the like, in particular on a fabric made of polyester fibers. The stain can be fresh or older. The formulation according to the invention is effective whatever the type of paint to be cleaned, such as epoxide, polyurethane, acrylic or alkyd paints, and the like.

The liquid formulation can be applied to the material to be treated by any appropriate means. Preferably, in the case of a textile material, said textile is immersed in the liquid formulation for the necessary time, for example one hour, at ambient temperature, or in a formulation heated to a temperature of between 30° C. and 80° C., for example 60° C. Subsequently, the textile is rinsed one or more times in municipal water and then dried in ambient air or in an oven. Alternatively, the textile can be subjected, subsequent to the stage of washing in the formulation of the present invention, to a second "conventional" washing, i.e. using a standard detergent, before final rinsing with water.

For the other cases of materials, in particular in the case of the cleaning of hard surfaces, for example metal surfaces, walls or floors, windows, and the like, the liquid formulation of the present invention can be applied by any appropriate means: using a rag, by spraying under pressure, by dipping or by any other method suited to the surface to be cleaned.

The formulation can also be employed in the context of operations for cleaning substrates during the manufacture of semiconductors, in particular of integrated circuits, or during the manufacture of printed circuit boards.

Other details or advantages of the present invention may become apparent in the light of the examples which follow, without a limiting nature.

Synthesis

Preparation of a Branched Diester Used in the Invention 43.26 g of a mixture M of dinitrile compounds are charged with 76.90 g of methanol in a glass reactor with a capacity of 500 ml which is equipped with a vertical reflux condenser and a stirrer and which is heated by an oil bath.

The mixture M of dinitrile compounds is composed of:

86.9% by weight of methylglutaronitrile 11.2% by weight of ethylsuccinonitrile 1.9% by weight of adiponitrile.

The remainder to 100% corresponds to the impurities present in this mixture, which are not generally dinitrile compounds.

The dinitrile compounds/methanol mixture is cooled to approximately 1° C. before the addition of 84.22 g of 98% by weight sulfuric acid.

The reaction medium is heated to reflux and maintained at this temperature for 3 h. The reaction mass is heterogeneous and fluid. After cooling to 60° C., 63 g of water are added. The reaction medium is maintained at 65° C. for 2 hours.

An additional 117 g of water are then added. The reaction medium becomes a two-phase medium. After removing the excess methanol by evaporation, the two phases are separated by settling and analyzed. The organic phase recovered is washed with a saturated aqueous sodium chloride solution with addition of aqueous ammonia solution in order to obtain a pH in the vicinity of 7.

A second washing is carried out with a saturated aqueous sodium chloride solution.

After distillation of the washed organic phase, a mixture with the following composition is obtained:

| | |
|---|---|
| Dimethyl ester of 2-methylglutaric acid | 89% |
| Dimethyl ester of 2-ethylsuccinic acid | 9% |
| Dimethyl ester of adipic acid | 1% |
| Various compounds | 1% |

EXAMPLES

Use is made of polyester working overalls stained by paint for approximately one month. The stains correspond to the various types of paint coat applied, namely an adhesion primer, a base coat (paint and metal pigments) and a clear coat (transparent pigment-free resin, acting as protective coat).

The performances of the formulations are evaluated using a tergotometer: it involves a miniature reproduction of the washing machines of the USA, composed of six stainless steel pots to which are fitted oscillating agitators with variable agitation.

The pots are placed in a thermostatically controlled water tank.

The washing conditions are as follows:

1 l of liquid formulation is placed in the tergotometer at 60° C.

Agitator adjusted to (100±3) cycles/min

Washing for 1 hour with agitation

Bath ratio (weight of fabrics/weight of bath): approximately 1/32

Rinsings by hand with 1 l of municipal water: water is poured onto the washed fabric test specimens, which are subsequently agitated for 5 minutes; this rinsing process is carried out three times.

The effectiveness of this treatment is evaluated by determining the percentage of surface area of paint removed. A grade is assigned according to the following table I:

TABLE I

| % of surface area of paint removed | 0 | ]0-20[ | [20-40[ | [40-60[ | [60-80[ | [80-100] |
|---|---|---|---|---|---|---|
| Grade | 0 | 1 | 2 | 3 | 4 | 5 |

Use is made, in preparing the formulations according to the present invention, of:

the branched diester obtained according to the synthesis described above, in combination with 3% by weight of the ethoxylated/propoxylated terpene surfactant Rhodoclean® MSC sold by Rhodia, a linear diester: Rhodiasolv® RPDE, sold by Rhodia, in combination with 3% by weight of the polyalkoxylated terpene surfactant Rhodaclean® MSC sold by Rhodia, this surfactant being as a 50/50 mixture with water.

Use is made, by way of comparison, of:

the branched diester obtained according to the synthesis described above, alone, the linear diester Rhodiasolv® RPDE, alone, an alkaline detergent: concentration at 0.36% of an alkaline detergent formed of 45%+/−2% of active material comprising 1/3 of NaOH or KOH pellets, 1/3 of sodium metasilicate or silicate and 1/3 of tetra-potassium diphosphate+3% of polyalkoxylated terpene surfactant.

The various formulations are summarized in table II below:

TABLE II

| Formulation | Component |
|---|---|
| Ex. 1 (comp.) | Alkaline detergent |
| Ex. 2 (comp.) | Branched diester, alone |
| Ex. 3 (comp.) | Linear diester (Rhodiasolv ® RPDE), alone |

TABLE II-continued

| Formulation | Component |
|---|---|
| Ex. 4 (inv.) | Branched diester + 3% by weight of surfactant (Rhodoclean ® MSC) |
| Ex. 5 (inv.) | Linear diester + 3% by weight of surfactant (Rhodoclean ® MSC) |

The results obtained are shown in table III below:

TABLE III

| Type of stain/Grade | Ex. 1 (comp.) | Ex. 2 (comp.) | Ex. 3 (comp.) | Ex. 4 (inv.) | Ex. 5 (inv.) |
|---|---|---|---|---|---|
| Clear coat | 1 | 1 | 1 | 5 | 5 |
| Base coat | 1 | 2 | 2 | 3 | 5 |
| Primer | 2 | 5 | 5 | 5 | 5 |

The results of table III show that the use of formulations according to the invention, comprising a specific diester and an ethoxylated/propoxylated terpene nonionic surfactant, in the cleaning of paints on fabrics makes it possible to obtain better performances than those obtained with a conventional detergent or a diester used alone.

What is claimed is:

1. A liquid formulation useful for the treatment/cleaning of textile and other materials, comprising:

at least one dicarboxylic acid diester having the formula (I):

$$R^1—OOC\text{-}A\text{-}COO—R^2 \quad (I)$$

wherein:

$R^1$ and $R^2$, which may be identical or different, are each a linear or branched, cyclic or non-cyclic, $C_1$-$C_{20}$ alkyl, aryl, alkylaryl or arylalkyl radical, the A group is a linear or branched divalent alkylene radical, and at least one polyalkoxylated terpene nonionic surfactant.

2. The liquid formulation as defined by claim 1, wherein the polyalkoxylated terpene nonionic surfactant is a polyethoxylated and/or polypropoxylated terpene, optionally a polyethoxylated and polypropoxylated terpene, the ethoxy and propoxy structural units being distributed randomly or sequentially.

3. The liquid formulation as defined by claim 1, wherein the nonionic surfactant is a polyalkoxylated terpene having the following formula (III):

$$Z—X[CH(R^5)—CH(R^6)—O]_n[CH_2CH_2—O]_p—[CH(R^5)—CH(R^6)—O]_q—R^7 \quad (III)$$

in which formula:

Z is a bicyclo[a.b.c]heptenyl or bicyclo[a.b.c.]heptyl radical, with a+b+c=5, a=2, 3 or 4, b=2 or 1, c=0 or 1, said radical optionally being substituted by at least one $C_1$-$C_6$ alkyl radical and comprising a Z backbone selected from among those set forth below or with the corresponding backbones devoid of a double bond:

[3.2.0]

a)

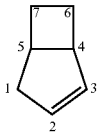

[3.2.0]

b)

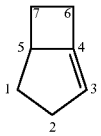

[2.2.1]

c)

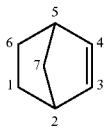

[3.1.1]

d)

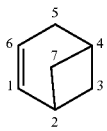

[3.1.1]

e)

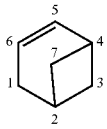

[4.1.0]

f)

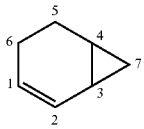

[4.1.0]

g)

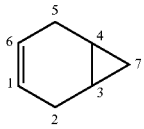

X is $—CH_2—C(R^3)(R^4)—O—$ or $—O—CH(R'^3)—C(R'^4)—O—$, in which:

$R^3$, $R^4$, $R'^3$ and $R'^4$, which may be identical or different, are each hydrogen or a saturated or unsaturated and linear, branched or cyclic $C_1$-$C_{22}$ hydrocarbon radical;

$R^5$ and $R^6$, which may be identical or different, are each hydrogen or a saturated or unsaturated and linear, branched or cyclic $C_1$-$C_{22}$ hydrocarbon radical, with the proviso that at least one of the $R^5$ and $R^6$ radicals is other than hydrogen;

$R^7$ is hydrogen or a saturated or unsaturated, linear, branched or cyclic, aromatic or non-aromatic, $C_1$-$C_{22}$ hydrocarbon radical which is optionally substituted;

n, p and q are integers or non-integers greater than or equal to 0, and n+p+q>1, optionally ranging from 2 to 200.

4. The liquid formulation as defined by claim 3, wherein:

n is an integer or non-integer ranging from 2 to 10 inclusive;

p is an integer or non-integer ranging from 3 to 20 inclusive;

q is an integer or non-integer ranging from 0 to 30 inclusive.

5. The liquid formulation as defined by claim 1, wherein formula (I), $R^1$ and $R^2$, which may be identical or different, are each selected from the group consisting of the methyl, ethyl, n-propyl, isopropyl, benzyl, phenyl, n-butyl, isobutyl, cyclohexyl, hexyl, n-hexyl, isooctyl and 2-ethylhexyl radicals.

6. The liquid formulation as defined by claim 1, wherein the dicarboxylic acid diester comprises a mixture of different dicarboxylic acid diesters of formula (I).

7. The liquid formulation as defined by claim 1, wherein formula (I), A is a branched divalent $C_3$-$C_{10}$ alkylene radical.

8. The liquid formulation as defined by claim 7, wherein in formula (I), the A group is selected from the group consisting of the $A_{MG}$ group of formula —$CH(CH_3)$—$CH_2$—$CH_2$—, the $A_{ES}$ group of formula —$CH(C_2H_5)$—$CH_2$— and mixtures thereof.

9. The liquid formulation as defined by claim 7, wherein the dicarboxylic acid diester has the following formula:

$$CH_3—OOC—CH(CH_3)—CH_2—CH_2—COO—CH_3.$$

10. The liquid formulation as defined by claim 1, wherein the dicarboxylic acid diester comprises a mixture of the dicarboxylic acid diesters of the following formulae (I'), (I") and optionally (II):

$$R^1—OOC\text{-}A_{MG}\text{-}COO—R^2 \quad (I'),$$

$$R^1—OOC\text{-}A_{ES}\text{-}COO—R^2 \quad (I''),$$

$$\text{optionally } R^1—OOC—(CH_2)_4—COO—R^2 \quad (II),$$

wherein:

$A_{MG}$ is a radical of formula —$CH(CH_3)$—$CH_2$—$CH_2$—, and $A_{ES}$ is a radical of formula —$CH(C_2H_5)$—$CF_{12}$—.

11. The liquid formulation as defined by claim 10, wherein the $R^1$ and $R^2$ groups are methyl radicals.

12. The liquid formulation as defined by claim 10, wherein the mixture comprises:

from 70 to 95% by weight of the dicarboxylic acid diester of formula (I'), from 5 to 30% by weight of the dicarboxylic acid diester of formula (I"), and from 0 to 10% by weight of the dicarboxylic acid diester of formula (II).

13. The liquid formulation as defined by claim 1, wherein in formula (I), A is a linear divalent alkylene radical of formula $(CH_2)_r$, wherein r is a mean number ranging from 2 to 4 inclusive.

14. The liquid formulation as defined by claim 13, wherein the dicarboxylic acid diester is dimethyl adipate (r=4), a mixture of dimethyl adipate, dimethyl glutarate (r=3) and dimethyl succinate (r=2), diisobutyl adipate or a mixture of diisobutyl adipate, diisobutyl glutarate and diisobutyl succinate.

15. The liquid formulation as defined by claim 14, wherein the dicarboxylic acid diester comprises a mixture of:

from 9 to 17% by weight of dimethyl adipate, from 59 to 67% by weight of dimethyl glutarate, and from 20 to 28% by weight of dimethyl succinate.

16. The liquid formulation as defined by claim 1, wherein the amount of polyalkoxylated terpene nonionic surfactant ranges from 0.1 and 5% by weight, with respect to the total amount of dicarboxylic acid diester compounds present in said formulation.

17. A procedure for the treatment/cleaning of a textile and other materials comprising treating/cleaning same with a liquid formulation of at least one dicarboxylic acid diester having the formula (I) and at least one polyalkoxylated terpene non-ionic surfactant, as defined by claim 1.

18. The procedure as defined by claim 17, said polyalkoxylated terpene nonionic surfactant having the formula (III), $$Z—X—[CH(R^5)—CH(R^6)—O]_n—[CH_2CH_2—O]_p—[CH(R^5)—CH(R^6)—O]_q—R^7 \quad (III)$$

in which formula:

Z is a bicyclo[a.b.c]heptenyl or bicyclo[a.b.c.]heptyl radical, with a+b+c=5, a=2, 3 or 4, b=2 or 1, c=0 or 1, said radical optionally being substituted by at least one $C_1$-$C_6$ alkyl radical and comprising a Z backbone selected from among those set forth below or with the corresponding backbones devoid of a double bond:

[3.2.0]

a)

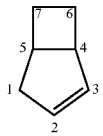

[3.2.0]

b)

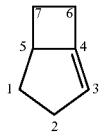

[2.2.1]

c)

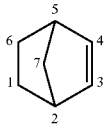

[3.1.1]

d)

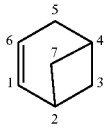

[3.1.1]

-continued e)

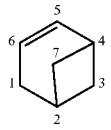

[4.1.0]

f)

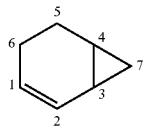

[4.1.0]

g)

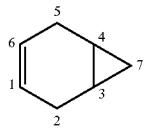

X is —$CH_2$—C($R^3$)($R^4$)—O— or —O—CH($R'^3$)—C($R'^4$)—O—, in which:

$R^3$, $R^4$, $R'^3$ and $R'^4$, which may be identical or different, are each hydrogen or a saturated or unsaturated and linear, branched or cyclic $C_1$-$C_{22}$ hydrocarbon radical;

$R^5$ and $R^6$, which may be identical or different, are each hydrogen or a saturated or unsaturated and linear, branched or cyclic $C_1$-$C_{22}$ hydrocarbon radical, with the proviso that at least one of the $R^5$ and $R^6$ radicals is other than hydrogen;

$R^7$ is hydrogen or a saturated or unsaturated, linear, branched or cyclic, aromatic or non-aromatic, $C_1$-$C_{22}$ hydrocarbon radical which is optionally substituted;

n, p and q are integers or non-integers greater than or equal to 0, and n+2+q>1, optionally ranging from 2 to 200.

19. The procedure as defined by claim 17, said material to be treated is selected from the group consisting of textiles, metals and plastics.

20. The procedure as defined by claim 17, said treatment of materials comprises cleaning same to remove therefrom a stain, a coating or an agent for assisting in the manufacture thereof.

21. The procedure as defined by claim 20, wherein said stain is a stain of aqueous- or solvent-based single-component or two-component paint, of resin, of vegetable- or mineral-based lubricant, of products derived from bitumens and petroleum, of mud, of greasy substances or of food residues.

* * * * *